US012305938B2

(12) United States Patent
Hornig et al.

(10) Patent No.: US 12,305,938 B2
(45) Date of Patent: May 20, 2025

(54) HEAT EXCHANGER FOR A COOLING SYSTEM, COOLING SYSTEM, AND ASSEMBLY

(71) Applicant: Bayerische Motoren Werke Aktiengesellschaft, Munich (DE)

(72) Inventors: Harald Hornig, Vaterstetten (DE); Anke Steinkrug, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/786,713

(22) Filed: Oct. 18, 2017

(65) Prior Publication Data

US 2018/0038661 A1 Feb. 8, 2018

Related U.S. Application Data

(63) Continuation of application No. PCT/EP2016/061234, filed on May 19, 2016.

(30) Foreign Application Priority Data

Jun. 3, 2015 (DE) ..... 10 2015 210 231.9

(51) Int. Cl.
*F28F 9/02* (2006.01)
*F01P 3/18* (2006.01)
(Continued)

(52) U.S. Cl.
CPC ..... *F28F 9/0246* (2013.01); *F01P 3/18* (2013.01); *F28D 1/05316* (2013.01);
(Continued)

(58) Field of Classification Search
CPC ..... F28F 9/0246; F28F 9/0209; F28F 2009/0297; F28F 2009/029; F28F 9/0263;
(Continued)

(56) References Cited

U.S. PATENT DOCUMENTS 2,536,840 A * 1/1951 Cornell, Jr. ..... F25B 39/022 165/77
3,746,083 A * 7/1973 Tiefenbacher ..... F28D 7/06 165/83
(Continued)

FOREIGN PATENT DOCUMENTS

CN 1197015 A 10/1998
CN 1225714 A 8/1999
(Continued)

OTHER PUBLICATIONS

Specific Heat and Heat Capacity—Indiana University Northwest (Apr. 2001).*
(Continued)

*Primary Examiner* — Jenna M Maroney
(74) *Attorney, Agent, or Firm* — Crowell & Moring LLP

(57) ABSTRACT

The invention provides a heat exchanger for a cooling system of a motor vehicle, in particular a motorcycle. The heat exchanger includes a housing, a supply connection via which a fluid can be supplied to the heat exchanger, a return connection via which the cooled fluid can be discharged from the heat exchanger, and a heat exchange region in which the fluid interacts with a medium in order to be cooled. The fluid dispenses thermal energy to the medium. The supply connection and the return connection are arranged on a common connection side of the housing. The heat exchange region includes multiple heat exchanger tubes through which the fluid flows from the connection side to a side opposite the connection side. A singular discharge tube runs from the opposite side to the return connection. The invention further provides a cooling system and an assembly.

11 Claims, 2 Drawing Sheets

(51) Int. Cl.
*F28D 1/02* (2006.01)
*F28D 1/053* (2006.01)
*F28D 21/00* (2006.01)

(52) U.S. Cl.
CPC ..... *F28D 1/05375* (2013.01); *F28F 9/02* (2013.01); *F01P 2050/16* (2013.01); *F28D 2001/026* (2013.01); *F28D 2001/0266* (2013.01); *F28D 2021/004* (2013.01); *F28D 2021/0094* (2013.01); *F28F 2009/0285* (2013.01); *F28F 2009/0297* (2013.01); *F28F 2280/06* (2013.01)

(58) Field of Classification Search
CPC ..... F28D 1/05391; F28D 7/1692; F28D 7/06; B60H 1/00328; B60H 1/00314; B60H 1/00492; B60H 1/02; B60H 1/04; B60H 1/06; B60H 1/08; B60H 2001/2271
See application file for complete search history.

(56) References Cited

U.S. PATENT DOCUMENTS 3,897,821 A * 8/1975 Babunovic ..... F28D 1/05375 165/175
4,673,032 A * 6/1987 Hara ..... F28D 1/05366 165/44
4,998,580 A * 3/1991 Guntly ..... F25B 39/04 165/173
5,101,890 A * 4/1992 Aoki ..... F25B 39/04 165/110
5,186,248 A * 2/1993 Halstead ..... B60H 1/3227 165/153
5,205,347 A * 4/1993 Hughes ..... F25B 39/02 165/144
5,477,919 A * 12/1995 Karube ..... F28D 1/05391 165/176
5,524,938 A * 6/1996 Halder ..... F28F 9/0246 228/173.1
5,529,117 A * 6/1996 Voss ..... F28F 9/0246 165/144
5,662,164 A * 9/1997 Nishishita ..... F28D 1/0341 165/153
5,664,432 A * 9/1997 O'Brien ..... B60H 1/3227 285/212
5,680,897 A * 10/1997 Kilmer ..... F28D 1/0341 165/153
5,697,546 A * 12/1997 Cicioni ..... B60H 1/00321 165/149
5,724,817 A * 3/1998 Nishishita ..... F25B 39/022 62/216
5,868,198 A * 2/1999 Kato ..... B21D 53/04 165/153
5,884,503 A * 3/1999 Inaba ..... F25B 39/04 62/509
5,964,281 A * 10/1999 Voss ..... F28D 1/05391 165/144
5,979,542 A * 11/1999 Inoue ..... C23F 13/14 165/133
6,000,465 A * 12/1999 Kawahara ..... F25B 39/04 165/110
6,055,360 A 4/2000 Inoue et al.
6,161,614 A * 12/2000 Woodhull, Jr. ..... F28D 1/05333 165/144
6,196,306 B1 * 3/2001 Aikawa ..... F28D 1/0333 165/153
6,199,401 B1 3/2001 Haussmann
6,293,334 B1 * 9/2001 Ghiani ..... F28D 1/05375 165/149
6,341,648 B1 1/2002 Fukuoka et al.
6,449,979 B1 9/2002 Nagasawa et al.
6,691,771 B1 * 2/2004 Shinhama ..... F25B 39/04 165/132
6,814,136 B2 * 11/2004 Yi ..... F28D 1/0341 165/153
6,904,963 B2 * 6/2005 Hu ..... F28D 1/0443 165/140
7,222,501 B2 * 5/2007 Cho ..... F28D 1/05391 62/515
7,347,064 B2 * 3/2008 Katoh ..... F25B 39/02 165/176
7,398,820 B2 * 7/2008 Inaba ..... F25B 39/022 165/153
7,549,466 B2 * 6/2009 Hayashi ..... F28D 1/0341 165/153
8,720,529 B2 * 5/2014 Suzuki ..... B60H 1/00328 165/42
9,429,372 B2 * 8/2016 Hirsch ..... F28F 9/02
9,573,441 B2 * 2/2017 Haussmann ..... B60H 1/005
9,797,656 B2 * 10/2017 Matsumoto ..... F28F 9/0204
10,060,649 B2 * 8/2018 Kim ..... F24H 3/0429
2003/0159816 A1 * 8/2003 Kodumudi ..... F28F 9/001 165/176
2005/0171749 A1 * 8/2005 Watanabe ..... G06F 30/20 703/8
2005/0274506 A1 * 12/2005 Bhatti ..... F28D 1/05391 165/177
2006/0118283 A1 * 6/2006 Hanafusa ..... F25B 39/022 165/153
2006/0288727 A1 * 12/2006 Aikawa ..... B60H 1/005 62/434
2007/0044949 A1 * 3/2007 Ohashi ..... F28D 1/05391 165/176
2007/0095503 A1 * 5/2007 Sinha ..... F28D 1/05366 165/41
2007/0204983 A1 * 9/2007 Ichiyanagi ..... F25B 9/008 165/176
2007/0209787 A1 * 9/2007 Hiyama ..... F28F 9/0246 165/178
2008/0029254 A1 * 2/2008 Sekito ..... F28D 1/05366 165/148
2008/0066696 A1 * 3/2008 Hirayama ..... F01P 3/04 123/41.79
2008/0164015 A1 * 7/2008 Papapanu ..... F28D 1/05375 165/176
2008/0223566 A1 * 9/2008 Higashiyama ..... F28D 1/05391 165/176
2008/0296007 A1 * 12/2008 Harris ..... F28F 9/0246 165/178
2008/0314076 A1 * 12/2008 Ichiyanagi ..... F25B 9/008 62/513
2009/0056921 A1 * 3/2009 Arino ..... F28D 1/05391 165/153
2009/0173483 A1 * 7/2009 Beamer ..... B21D 53/06 165/173
2009/0236086 A1 * 9/2009 Higashiyama ..... F25B 39/02 165/176
2009/0266104 A1 * 10/2009 Ichiyanagi ..... F25B 39/00 62/498
2010/0051228 A1 * 3/2010 Han ..... F16K 11/072 165/41
2010/0187033 A1 * 7/2010 Hayashi ..... B62K 19/30 180/68.4
2011/0139421 A1 * 6/2011 Coyle ..... F28D 1/05391 165/173
2011/0240276 A1 * 10/2011 Wintersteen ..... F28D 1/05383 165/173
2011/0303402 A1 12/2011 Gu et al.
2012/0102974 A1 * 5/2012 Kawazoe ..... B60H 1/00035 62/3.61
2012/0318473 A1 * 12/2012 Nishikawa ..... B60H 1/00328 165/41
2013/0299151 A1 * 11/2013 Gregus-Kollar ..... F28F 9/0248 165/175
2014/0026832 A1 1/2014 Yamashiro et al.
2014/0069604 A1 * 3/2014 Tamakoshi ..... B60K 11/04 165/42

(56) References Cited

U.S. PATENT DOCUMENTS

| | | | | |
|---|---|---|---|---|
| 2014/0208793 | A1* | 7/2014 | Goenka | F25D 31/00 62/404 |
| 2014/0208794 | A1* | 7/2014 | Goenka | B60H 1/00328 62/404 |
| 2015/0168072 | A1* | 6/2015 | Ueno | F24F 13/30 165/144 |

FOREIGN PATENT DOCUMENTS

| | | | | | |
|---|---|---|---|---|---|
| CN | 1292484 | A | | 4/2001 | |
| CN | 102288049 | A | | 12/2011 | |
| DE | 36 08 232 | A1 | | 9/1987 | |
| DE | 0564761 | A1 | * | 1/1993 | |
| DE | 42 12 070 | A1 | | 10/1993 | |
| DE | 36 50 648 | T2 | | 4/1999 | |
| DE | 10 2006 028 936 | A1 | | 3/2007 | |
| DE | 102007018879 | A1 | * | 10/2007 | F28D 1/0391 |
| DE | 102011007749 | A1 | * | 10/2011 | F28D 1/05375 |
| DE | 10 2010 028 867 | A1 | | 11/2011 | |
| DE | 102010053568 | A1 | * | 6/2012 | F01M 5/002 |
| DE | 10 2013 217 287 | A1 | | 3/2014 | |
| EP | 0219974 | A2 | * | 4/1987 | F25B 39/04 |
| EP | 564761 | A2 | * | 10/1993 | |
| EP | 1467170 | A2 | * | 10/2004 | F28F 9/0246 |
| EP | 1531309 | A2 | * | 5/2005 | F25B 39/04 |
| EP | 2 159 093 | A1 | | 3/2010 | |
| EP | 2397806 | A2 | * | 12/2011 | F28D 1/05366 |
| EP | 2520887 | A2 | * | 11/2012 | F28D 1/05366 |
| GB | 1531309 | A2 | * | 5/2005 | F25B 39/04 |
| JP | H0534090 | A | * | 2/1993 | |
| JP | 08136182 | A | * | 5/1996 | F28F 9/0243 |
| JP | 08170896 | A | * | 7/1996 | F28B 1/02 |
| JP | WO 2007083680 | A1 | * | 7/2007 | F25B 9/006 |
| JP | 102011007749 | A1 | * | 10/2011 | F28D 1/05375 |
| WO | WO-2007083680 | A1 | * | 7/2007 | F25B 9/006 |

OTHER PUBLICATIONS

Specific Heat Capacity of Water Water Properties, USGS Water Science School—Mar. 2014.*

JP H0534090 A English Machine Translation (Year: 1993).*

Thulukkanam, K. (2013). Heat Exchanger Design Handbook (2nd ed.). Chapter 3. pp. 125-126. CRC Press. https://doi.org/10.1201/b14877 (Year: 2013).*

International Search Report (PCT/ISA/210) issued in PCT Application No. PCT/EP2016/061234 dated Aug. 30, 2016 with English translation (seven pages).

German-language Written Opinion (PCT/ISA/237) issued in PCT Application No. PCT/EP2016/061234 dated Aug. 30, 2016 (six pages).

German-language Search Report issued in counterpart German Application No. 10 2015 210 231.9 dated Feb. 12, 2016 with partial English translation (12 pages).

Chinese-language Office Action issued in counterpart Chinese Application No. 201680014818.6 dated Sep. 30, 2018 with English translation (17 pages).

Chinese-language Office Action issued in counterpart Chinese Application No. 201680014818.6 dated Sep. 29, 2019 with English translation (13 pages).

German-language Office Action issued in German Application No. 10 2015 210 231.9 dated Jun. 28, 2024 (5 pages).

* cited by examiner

HEAT EXCHANGER FOR A COOLING SYSTEM, COOLING SYSTEM, AND ASSEMBLY

CROSS REFERENCE TO RELATED APPLICATIONS

This application is a continuation of PCT International Application No. PCT/EP2016/061234, filed May 19, 2016, which claims priority under 35 U.S.C. § 119 from German Patent Application No. 10 2015 210 231.9, filed Jun. 3, 2015, the entire disclosures of which are herein expressly incorporated by reference.

BACKGROUND AND SUMMARY OF THE INVENTION

The invention relates to a heat exchanger for a cooling system of a motor vehicle, a cooling system for a motor vehicle as well as an assembly comprising an engine and a cooling system.

Heat exchangers are used in cooling systems in order to transfer heat energy of a fluid to a different medium which flows around the heat exchanger. For example, the medium can be air and the fluid can be water so that the heat exchanger is a water cooler through which air flows. Such heat exchangers are normally used in the field of motor vehicle engine technology since current engines have to be water-cooled as a result of their high specific output in order to be able to adequately discharge the generated heat. This means that the heat of the engine is transferred to the water and discharged from the engine via the heated water. The water flows from the engine into the heat exchanger, wherein the water heated by the engine heat interacts with the air which flows around the heat exchanger and is thus cooled. Such cooling is generally referred to as indirect cooling since the engine does not discharge the excess heat directly to the ambient air, rather initially to the fluid.

The cooling systems in which the heat exchangers are used are normally formed as closed overpressure systems. This means that a pressure valve is provided in the cooling circuit which generates an overpressure between 1.2 and 1.5 bar so that the boiling point of the fluid is above 120° C.

The heat exchangers known from the prior art can be divided into two groups which are referred to as heat exchangers with I-throughflow and heat exchangers with U-throughflow.

The heat exchangers with I-throughflow are characterized in that the heat exchanger has a supply connection on a first side and a return connection on a second side opposite the first side. The fluid supplied to the heat exchanger flows through the heat exchanger in a heat exchanger region therefore only in one direction, wherein the cooling of the fluid is performed via cooling ribs around which air flows.

The heat exchangers with I-throughflow have the disadvantage that the connections are provided on opposite sides, as a result of which installation and assembly are made correspondingly more difficult since tubes must be connected from both sides. In order to avoid this problem, it is known from the prior art that a complex tube guide is guided from the return connection to the fluid pump. However, this results in higher materials costs and higher weight since an additional hose or an additional tube must be provided. The assembly outlay and the assembly costs are furthermore increased.

In contrast, the heat exchangers with U-throughflow have the supply connection and the return connection on the same side of the heat exchanger. Within the heat exchanger, the two connections open in each case into several tubes which form a transition in turn into a collecting and distributor portion or proceed therefrom, as a result of which the deflection of the fluid in the heat exchanger is possible. The number of tubes from the supply connection to the collecting and distributor portion is identical to the number of tubes of the collecting and distributor portion up to the return connection since the counter-pressure is kept as low as possible as a result of this. The fluid thus flows via the supply connection through a first tube into the collecting and distributor portion and from the collecting and distributor portion via a second tube to the return connection. This results in a doubling of the flow distance in the heat exchanger region which results in an increase in the counter-pressure with the same flow quantity if the number of tubes is reduced. A counter-pressure which is higher by a factor of 6 is produced, for example, in the case of halving the tubes. This requires a pump with a correspondingly higher drive output in order to be able to counteract the counter-pressure. Such a pump also increases, however, the power loss, as a result of which the efficiency of the cooling system is correspondingly reduced.

It is therefore known from the prior art to operate the heat exchangers with U-throughflow with a low throughflow quantity in order to counteract the enormous rise in the counter-pressure. As a result of this, however, the temperature difference between the supply connection and the return connection becomes higher, i.e. in the case of the same admissible maximum temperature, the average coolant temperature becomes lower. The average driving input temperature difference in the heat exchanger accordingly becomes lower, which results in a correspondingly inferior cooling performance of the heat exchanger.

In order to again counteract this inferior cooling performance, it is known from the prior art to form the heat exchangers with U-throughflow to be larger than the heat exchangers with I-throughflow so that the same cooling performance can be provided. As a result of this, however, further disadvantages arise since the heat exchanger has larger dimensions, as a result of which, among other things, the air resistance increases, which is disadvantageous in particular when using the heat exchanger in a motorcycle.

An object of the invention is to provide a heat exchanger as well as a cooling system which has a simple and compact structure as well as high cooling performance.

This and other objects are achieved in accordance with embodiments of the invention. According to a preferred embodiment, a heat exchanger for a cooling system of a motor vehicle, in particular of a motorcycle, includes a housing, a supply connection via which a fluid can be supplied to the heat exchanger, and a return connection via which the cooled fluid can be discharged from the heat exchanger. The heat exchanger includes a heat exchange region in which the fluid interacts with a medium in order to be cooled where it discharges heat energy to the medium. The supply connection and the return connection are arranged on a common connection side of the housing. The heat exchanger region includes a plurality of heat exchanger tubes through which the fluid flows from the connection side to a side opposite the connection side. A singular discharge tube leads from the opposite side to the return connection.

The basic concept of the invention is to provide a heat exchanger which externally corresponds to a heat exchanger with U-throughflow since the supply connection and the return connection are formed on the same connection side, as a result of which the heat exchanger can be expediently installed or mounted. Moreover, the heat exchanger internally resembles a heat exchanger with I-throughflow since the fluid flows via a plurality of heat exchanger tubes from the supply connection in a direction through the heat exchange region. The singular tube which forms the return flow of the fluid to the return connection represents a return, formed in the heat exchanger, of the fluid which flows through the heat exchanger which corresponds in terms of the heat exchange region to a heat exchanger with I-throughflow. Return to the return connection is thus carried out via a single discharge tube.

One aspect provides that the heat exchanger tubes open in each case into a collecting portion which is fluidly connected to the return connection. The fluid which flows through the respective heat exchanger tubes is collected in the collecting portion of the heat exchanger. The collecting portion differs from a collecting and distributor portion known from the prior art in that no distribution to individual tubes is carried out since the fluid collected in the collecting portion is guided jointly via the singular discharge tube to the return connection.

According to a further aspect, the hydraulic diameter of the discharge tube is approximately equal to or greater than that of all heat exchanger tubes. As a result of the larger throughflow cross-section, it is possible that the fluid flowing through the individual heat exchanger tubes can be discharged via the singular discharge tube to the return connection and then out of the heat exchanger. The larger throughflow cross-section ensures that the counter-pressure only rises to a small degree. A more powerful pump is accordingly not required. The heat exchanger can furthermore be operated with the normal throughflow quantities, as a result of which there is no deterioration in cooling performance. The heat exchanger correspondingly also does not require a larger space in order to provide comparable cooling performance as is required in the prior art.

Moreover, the discharge tube can be arranged in a lower region of the heat exchanger in the installation position of the heat exchanger. As a result of this, advantages are achieved in terms of pressure distribution in the singular discharge tube and the individual heat exchanger tubes. This in turn improves the cooling performance of the heat exchanger.

A further aspect provides that the heat exchanger tubes are arranged in an upper region of the heat exchanger in the installation position of the heat exchanger. The upper region is particularly well suited to the heat exchanger tubes since more air flows around this region of the heat exchanger in the installation position. Correspondingly, higher cooling performance of the heat exchanger is produced as a result of this.

In particular, the fluid is water and/or the medium is air, for example. The heat exchanger can accordingly be a water cooler around which air flows.

According to a further aspect, the supply connection opens into a fluid distributor portion running along the connection side, from which the heat exchanger tubes connected in parallel proceed. The fluid supplied via the supply connection to the heat exchanger is distributed in the fluid distributor portion to the individual heat exchanger tubes so that fluid flows uniformly through the heat exchanger tubes, as a result of which a correspondingly high cooling performance of the heat exchanger is produced.

The supply connection and the return connection can lie next to each other and preferably at a lower end portion of the connection side in the installation position. As a result of this, mounting of the heat exchanger and connecting the heat exchanger in the cooling system are made easier since the connections are easily accessed. A higher degree of freedom in terms of the configuration of the design of the cooling system and/or the engine is achieved since the two connections are arranged in a small region so that only this small region has to be accessible from outside.

The invention furthermore relates to a cooling system for a motor vehicle, in particular for a motorcycle, with a fluid pump and a heat exchanger of the above-mentioned type. The above-mentioned advantages in terms of the heat exchanger can be transferred in an analogous manner to the cooling system. The fluid pump can be formed in particular as a water pump.

The invention further relates to an assembly comprising an engine as well as a cooling system of the above-mentioned type or a heat exchanger of the above-mentioned type. The engine is fluidly connected to the heat exchanger and is cooled by the fluid. The engine has a fluid inlet and a fluid outlet which are fluidly connected to the return connection or the supply connection, in particular wherein the fluid inlet and the fluid outlet are formed on a common side of the engine. As a result of this, a very compact design of the assembly is produced since the respective flow connections between the engine and the heat exchanger can be easily formed. A higher degree of freedom of configuration is furthermore achieved since only small regions in which the connections are formed have to be accessible from the outside.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
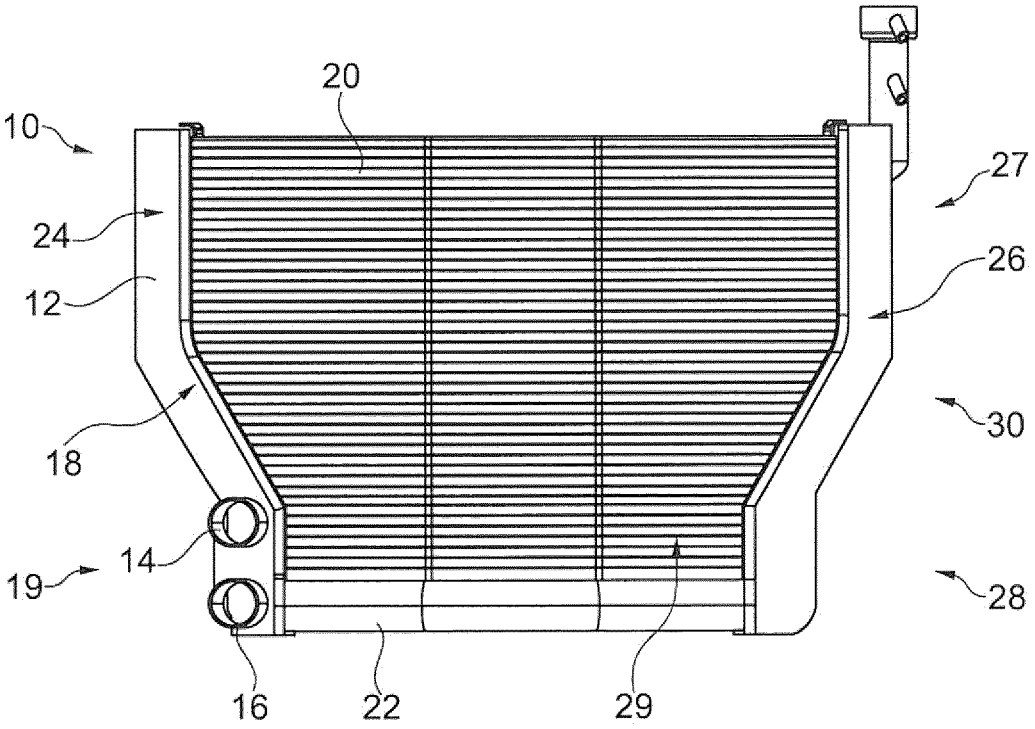
FIG. 1 is a plan view of a heat exchanger according to the invention.

A heat exchanger 10 for a cooling system of a motor vehicle is shown in FIG. 1. The heat exchanger 10 has a housing 12.

The heat exchanger 10 includes a supply connection 14 as well as a return connection 16 which are both arranged on a connection side 18 of the housing 12. The supply connection 14 and the return connection 16 are arranged in a lower end portion 19 of the connection side 18 in the installation position.

The supply connection 14 is fluidly connected to the return connection 16. The flow connection is formed via several heat exchanger tubes 20 as well as a singular discharge tube 22. The heat exchanger tubes 20 are provided in the embodiment shown.

Figure 2:
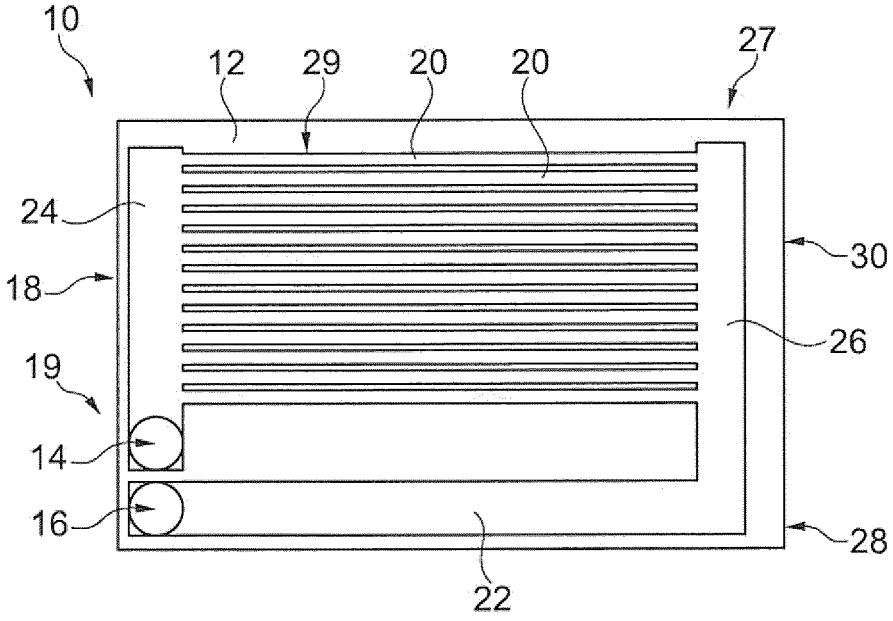
FIG. 2 is a schematic sectional view of the heat exchanger according to the invention.

The heat exchanger 10 furthermore has a fluid distributor portion 24 and a collecting portion 26 which are shown in particular in FIG. 2. The collecting portion 26 runs substantially parallel to the fluid distributor portion 24 which runs along the connection side 18. The heat exchanger tubes 20 connected in parallel as well as the singular discharge tube 22 run parallel to one another and in each case perpendicular to the fluid distributor portion 24 and proceed from the fluid distributor portion 24 and open next to one another into the collecting portion 26.

FIGS. 1 and 2 show the heat exchanger 10 in its installation position so that the upper region in the figures corresponds to the upper region in the installation position. It is apparent from this that the heat exchanger tubes 20 are arranged in an upper region 27 of heat exchanger 10, whereas the discharge tube 22 is arranged in a lower region 28 of heat exchanger 10 in the installation position.

The mode of operation of the heat exchanger 10 is explained below.

A fluid, which can, for example, be water, is supplied to the heat exchanger 10 via the supply connection 14. The fluid can flow from an engine (not shown) to the heat exchanger 10 so that the fluid is heated as a result of the heat discharged in the engine.

The fluid supplied via the supply connection 14 then flows into the fluid distributor portion 24 in which the fluid is distributed to the individual heat exchanger tubes 20 in a homogeneous manner. Individual heat exchanger tubes 20 jointly form a heat exchange region 29 around which a medium flows, for example, air. The heated fluid discharges its heat energy to the medium. As a result of the large number of the heat exchanger tubes 20 and their small diameter, a large interaction surface is created for the medium via which a correspondingly high cooling performance can be provided.

The heat exchanger tubes 20 interact with the fluid distributor portion 24 in such a manner that the fluid flows in a uniform manner through the heat exchanger tubes 20, as a result of which greater cooling performance and improved efficiency of the heat exchanger 10 are ensured.

The fluid flowing through the heat exchanger tubes 20 reaches, at the end of the heat exchanger tubes 20, the collecting portion 26 in which the fluid is collected, which fluid flows through individual heat exchanger tubes 20. The collecting portion 26 is fluidly connected to the singular discharge tube 22 which is in turn coupled to the return connection 16. All the fluid collected in the collecting portion 26 is accordingly guided via the singular discharge tube 22 to the return connection 16. The fluid can subsequently be discharged via the return connection 16 out of the heat exchanger 10 and supplied to the engine (not shown). All the fluid supplied to the heat exchanger 10 is thus returned via the single discharge tube 22 once the fluid has flowed through the heat exchange region 29.

The fluid thus flows through individual heat exchanger tubes 20 only in one direction, namely from the connection side 18 to a side 30 opposite the connection side 18 on which the collecting portion 26 is formed. The collecting portion 26 thus extends along the opposite side 30.

The singular discharge tube 22 forms the return for the fluid which flows through the heat exchange region 29 since it returns the fluid from the opposite side 30 to the connection side 18. The discharge tube 22 is integrated in the heat exchanger 10 so that no additional assembly of hoses or other return components is required.

The heat exchange region 29 is primarily formed by the plurality of heat exchanger tubes 20. The singular discharge tube 22 can likewise interact with the medium.

So that the throughflow quantity flowing through the heat exchanger 10 is high, the discharge tube 22 has a larger throughflow cross-section than one of many heat exchanger tubes 20. In particular, the hydraulic diameter of the discharge tube 22 is approximately equal to or greater than that of the sum of all heat exchanger tubes 20. As a result, it is ensured that no high counter-pressure is generated which would result in a small throughflow quantity. It is therefore not necessary to use a correspondingly more powerful fluid pump or a heat exchanger with a large surface area. The heat exchange region 29 corresponds substantially in terms of size to that of a heat exchanger 10 with I-throughflow, wherein cooling performance thereof is also comparable.

As a result of the larger diameter of the discharge tube 22, it is ensured that the counter-pressure does not rise to such an extent that a higher power of a water pump (not shown) is required. As a result of the only small rise in the counter-pressure, an approximately identical throughflow quantity can act on the heat exchanger 10.

The heat exchanger 10 is correspondingly created which externally has the form of a heat exchanger with U-throughflow since the supply connection 14 and the return connection 16 are formed on a common connection side 18 of the housing 12. However, flow only takes place through the heat exchange region 29 in one direction, which is why the heat exchanger 10 corresponds in terms of the design principle of the heat exchange region 29 to that of a heat exchanger with I-throughflow. The heat exchanger 10 furthermore has the efficiency and cooling performance of a heat exchanger with I-throughflow.

Figure 3:
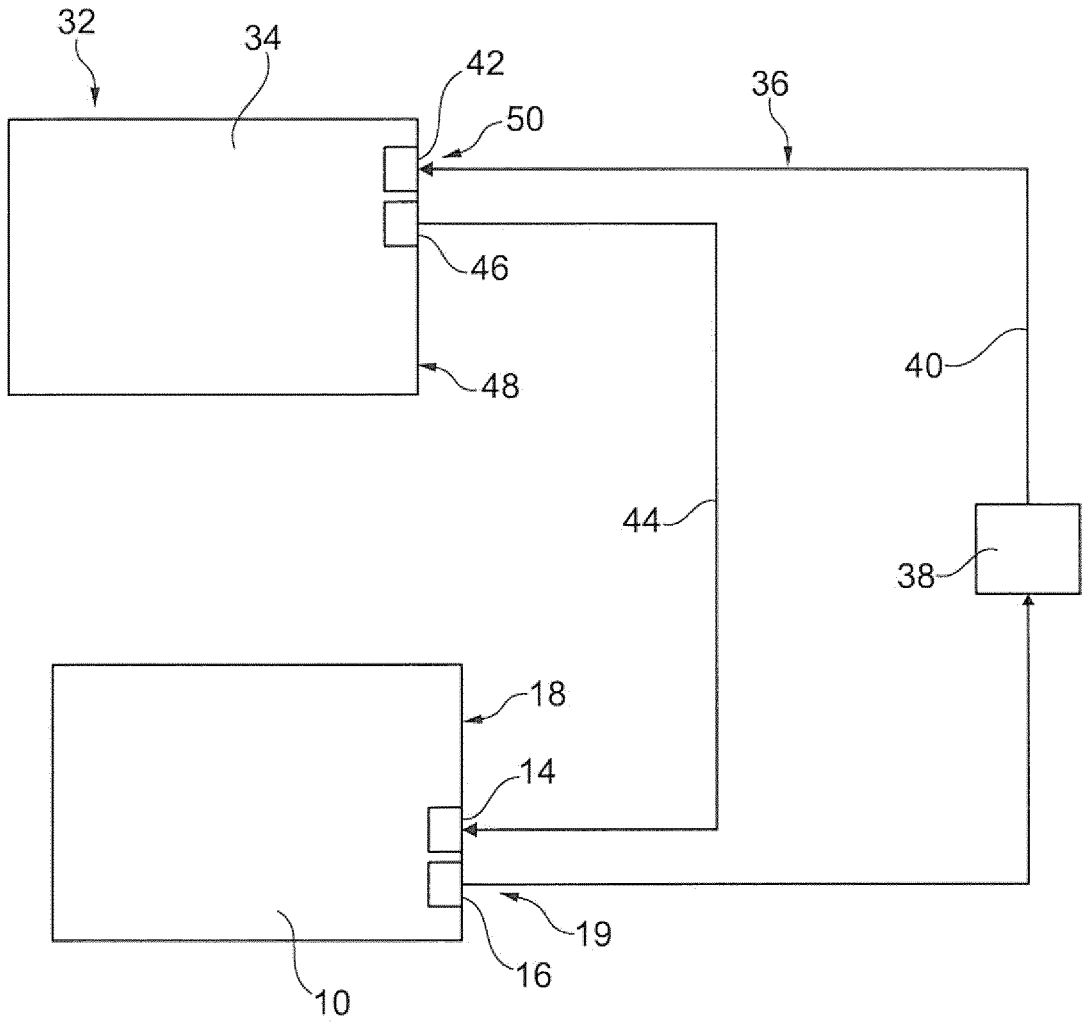
FIG. 3 is a schematic representation of an assembly according to the invention.

An assembly 32 which has an engine 34 and a cooling system 36 is shown schematically in FIG. 3.

The cooling system 36 includes a heat exchanger 10 of the above-mentioned type as well as a fluid pump 38 which is arranged in a flow connection 40 which connects the return connection 16 of the heat exchanger 10 to a fluid inlet 42 of the engine 34. A flow connection 44 is furthermore shown which is formed between a fluid outlet 46 of the engine 34 and the supply connection 14 of the heat exchanger 10. The cooling circuit formed in this manner ensures adequate cooling of the engine 34.

The fluid inlet 42 and the fluid outlet 46 can be arranged on a common side 48 of the engine 34, in particular in a small region 50 of the common side 48 so that the fluid inlet 42 and the fluid outlet 46 are directly adjacent. As a result of this, a compact design of the entire assembly 32 is achieved since the connections 14, 16 on the heat exchanger 10 are also formed in a lower end portion 19 of the common connection side 18.

There are thus created in general a heat exchanger 10, a cooling system 36 as well as an assembly 32 which have a simple, compact structure and nevertheless high cooling performance.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A motorcycle heat exchanger, comprising:

a housing;

a single supply connection via which a fluid is supplied to the motorcycle heat exchanger;

a single return connection via which cooled fluid is discharged from the motorcycle heat exchanger; and a heat exchange region in which the fluid interacts with a medium in order to be cooled where the fluid discharges heat energy to the medium during operation of the motorcycle, wherein the single supply connection and the single return connection are arranged next to each other on a same side of the housing located in a lower corner region of the housing in an installation position of the motorcycle heat exchanger, the heat exchange region comprises a plurality of heat exchanger tubes through which the fluid flows from the same side to a side opposite the same side, a single discharge tube leads from the side opposite the same side to the single return connection, and a hydraulic diameter of the single discharge tube is equal to a hydraulic diameter of a sum of all heat exchanger tubes.

2. The motorcycle heat exchanger according to claim 1, wherein the heat exchanger tubes open in each case into a collecting portion which is fluidly connected to the single return connection.

3. The motorcycle heat exchanger according to claim 2, wherein the single discharge tube is arranged in a lower region of the motorcycle heat exchanger in an installation position of the motorcycle heat exchanger.

4. The motorcycle heat exchanger according to claim 1, wherein the heat exchanger tubes are arranged in an upper region of the motorcycle heat exchanger in an installation position of the motorcycle heat exchanger.

5. The motorcycle heat exchanger according to claim 2, wherein the heat exchanger tubes are arranged in an upper region of the heat exchanger in an installation position of the motorcycle heat exchanger.

6. The motorcycle heat exchanger according to claim 1, wherein the fluid is water and/or the medium is air.

7. The motorcycle heat exchanger according to claim 1, wherein the single supply connection opens into a fluid distributor portion running along the same side, from which fluid distributor portion the heat exchanger tubes connected in parallel proceed.

8. The motorcycle heat exchanger according to claim 5, wherein the single supply connection opens into a fluid distributor portion running along the same side, from which fluid distributor portion the heat exchanger tubes connected in parallel proceed.

9. A motorcycle cooling system, comprising:

a fluid pump; and a motorcycle heat exchanger according to claim 1.

10. An assembly, comprising:

an engine; and a motorcycle cooling system according to claim 9, wherein the engine is fluidly connected to the motorcycle heat exchanger and is cooled by the fluid, and the engine has a fluid inlet and a fluid outlet which are fluidly connected to the single return connection or the single supply connection.

11. The assembly according to claim 10, wherein the fluid inlet and the fluid outlet are formed on a same side of the engine.

* * * * *